US005341104A

United States Patent [19]

Anton et al.

[11] Patent Number: 5,341,104

[45] Date of Patent: Aug. 23, 1994

[54] SYNCHROTRON RADIATION SOURCE

[75] Inventors: Frank Anton, Bonn; Andreas Jahnke, Munich, both of Fed. Rep. of Germany

[73] Assignee: Siemens Aktiengesellschaft, Munich, Fed. Rep. of Germany

[21] Appl. No.: 14,401

[22] Filed: Feb. 5, 1993

[51] Int. Cl.[5] ..... H05H 13/04

[52] U.S. Cl. ..... 328/235; 315/5.42; 313/361.1; 313/359.1; 328/229; 328/230; 328/233

[58] Field of Search ..... 328/235, 221, 228, 229, 328/230, 234, 236, 237, 238, 233; 313/62, 361.1, 359.1; 315/5.41, 5.42; 335/216; 250/396 R

[56] References Cited

U.S. PATENT DOCUMENTS

| | | | |
|---|---|---|---|
| 3,781,732 | 12/1973 | Wollnik | 225/213 |
| 3,867,635 | 2/1975 | Brown et al. | 335/396 R |
| 4,641,103 | 2/1987 | Madey et al. | 328/228 |
| 4,806,871 | 2/1989 | Ikegami et al. | 328/235 |
| 4,996,496 | 2/1991 | Kitamura et al. | 328/235 X |
| 5,006,759 | 4/1991 | Krispel | 328/228 X |

FOREIGN PATENT DOCUMENTS

| | | |
|---|---|---|
| 0277521 | 8/1988 | European Pat. Off. . |
| 0208163 | 1/1989 | . |
| 3148100 | 6/1983 | Fed. Rep. of Germany . |
| 3704442 | 8/1987 | Fed. Rep. of Germany . |
| 3530446 | 12/1989 | Fed. Rep. of Germany . |
| 2015821 | 9/1979 | United Kingdom . |
| 2109989 | 6/1983 | United Kingdom . |

OTHER PUBLICATIONS

Publication: Nuclear Instruments & Methods Research/Section B, B30 (1988) Feb. No. 1, pp. 105–109.; Moser et al "Nonlinear Beam Optics with Real Fields in Compact Storage Rings".

Publication; The Review of Scientific Instruments, vol. 14, No. 4 (1963), pp. 385–389; Enge; "Achromatic Magnetic Mirror for Ion Beams".

*Primary Examiner*—Donald J. Yusko

*Assistant Examiner*—Ashok Patel

*Attorney, Agent, or Firm*—Herbert L. Lerner; Laurence A. Greenberg

[57] ABSTRACT

A synchrotron radiation source includes a beam guidance system for accelerating and storing an electron or positron particle beam on a closed trajectory. In order to generate the synchrotron radiation, the beam guidance system has at least one approximately achromatic mirror magnet being formed of superconducting winding configurations and in which the trajectory is bent through approximately 270°. Further components of the beam guidance system, such as deflecting magnets and focusing magnets do not necessarily need to be constructed from superconducting components. The synchrotron radiation source permits the utilization of all of the advantages of superconductors with the most extensive avoidance of the disadvantages associated therewith, since the application of superconducting components can be restricted to the components specifically constructed for the generation of the synchrotron radiation.

16 Claims, 3 Drawing Sheets

SYNCHROTRON RADIATION SOURCE

CROSS-REFERENCE TO RELATED APPLICATION

This application is a Continuation of International Application Serial No. PCT/DE90/00605, filed Aug. 6, 1990.

BACKGROUND OF THE INVENTION

1. Field of the Invention

The invention relates to a synchrotron radiation source having a beam guidance system for accelerating and storing an electron or positron particle beam on a closed trajectory.

Such synchrotron radiation sources in which, inter alia, magnets formed of superconducting winding configurations are employed, are intended not only for a wide variety of applications in physics research, but they are also used as X-ray sources for purposes of lithography, preferably in the production of semiconductor chips.

Synchrotron radiation is created when an electron or positron particle beam is deflected from a linear trajectory. As a rule, the particle beam is guided (stored) in a beam guidance system on a closed trajectory, and use is made of the synchrotron radiation which is created in the deflecting magnets that are required to bend the trajectory. In order to achieve particularly efficient generation of synchrotron radiation, the trajectory should be bent with the smallest possible radius of curvature. That requires relatively large magnetic fields, which can only be generated in an economic manner for practical purposes, by using superconducting magnets.

2. Description of the Related Art

Synchrotron radiation sources with superconducting magnets are described, for example, in Published European Patent No. 0 208 163 B1, Published European Application No. 0 277 521 A2 and German Published, Non-Prosecuted Application DE 31 48 100 A1. In the simplest case, seen in German Published, Non-Prosecuted Application DE 31 48 100 A1, the synchrotron radiation source includes an electron storage ring with a superconducting magnet system. Such a synchrotron radiation source is especially compact, but the actual realization is difficult, due to the very restricted spatial conditions. Accordingly, it is proposed in Published European Application No. 0 208 163 B1 not to construct the beam guidance system for the electron beam in an annular configuration, but to provide two mutually spaced superconducting deflecting magnets, whereby the particle trajectory is given a "racetrack" form with two linear trajectory sections in which devices for accelerating as well as for injecting and/or extracting the particles may be disposed. Further developments of such a synchrotron radiation source may be inferred, for example, from Published European Application No. 0 277 521 A2.

German Published, Non-Prosecuted Application DE 31 48 100 A1 and Published European Application No. 0 277 521 A2 also contain indications as to the construction of a synchrotron radiation source for application in processes such as X-ray lithography and X-ray microscopy, preferably from the point of view of the selection of the energy of the particles to be stored and the corresponding structure of the magnets. In specific terms, the application of synchrotron radiation sources for the production of integrated circuits or the like with structures in the submicron range, is an important field of industrial application.

Further information on the construction of a synchrotron radiation source, preferably with regard to the structure of the deflecting magnets for the purpose of constructing a non-linear beam optical system, can be inferred from the article entitled "Nonlinear Beam Optics with Real Fields in Compact Storage Rings" by H. O. Moser, B. Krevet and A. J. Dragt, in Nuclear Instruments & Methods in Physics Research/Section B, B30 (1988) Feb. No. 1 pgs. 105–109.

A feature which is a disadvantage of the known configurations in certain circumstances is the problematic handling of the superconducting magnets. On one hand, the most stringent requirements are to be imposed on the mechanical construction of the magnets, which gives rise to correspondingly high production costs, and on the other hand, the application of time-variant current (which is required in the acceleration of a particle beam to a prescribed energy, for example) to superconducting magnets is very difficult, inter alia on account of the eddy currents created in the structures retaining the magnets in this case. Over and above such points, in a beam guidance system for storing a particle beam, as a rule it is desirable to provide devices for focusing the particle beam, in order to ensure good beam properties over relatively long periods of time and to avoid losses of intensity as far as possible. Published United Kingdom Application GB 2 015 821 A discloses a beam guidance system which is constructed with four achromatic deflecting magnets and contains no focusing devices whatsoever. Achromatic deflecting magnets, which can also be referred to as mirror magnets, are described, for example, in the article "Achromatic Magnetic Mirror for Ion Beams" by H. A. Enge, in The Review of Scientific Instruments Vol. 34, No. 4 (1963) pgs. 385–389. A beam guidance system according to Published United Kingdom Application GB 2 015 821 A is not suitable for storing a particle beam over relatively long periods of time, since after a few circuits in the beam guidance system, the particle beam is lost, if it is not previously extracted for onward guidance.

It is accordingly an object of the invention to provide a synchrotron radiation source, which overcomes the hereinafore-mentioned disadvantages of the heretofore-known devices of this general type, having a beam guidance system which permits both the acceleration as well as the longer-term storage of an electron or positron particle beam and in which the application of superconducting magnets can be restricted to a very substantial extent.

SUMMARY OF THE INVENTION

With the foregoing and other objects in view there is provided, in accordance with the invention, a synchrotron radiation source, comprising a beam guidance system for storing an electron or positron particle beam on a closed trajectory, the beam guidance system having at least one approximately achromatic mirror magnet being formed of superconducting winding configurations for bending the trajectory through approximately 270°.

According to the invention, the application of superconductors can be restricted to those components of the beam guidance system which are provided specifically for the purpose of the generation of synchrotron radiation. In specific terms, the synchrotron radiation source according to the invention includes at least one mirror magnet, which has winding configurations of superconducting strands and in which the trajectory is bent through approximately 270°, with the trajectory intersecting itself at a point of intersection having a position which to a large extent is independent of the energy of the particle beam executing the trajectory (this property forms the basis of the attribute "achromatic"). During the acceleration of a particle beam injected into the beam guidance system to a predetermined final energy, the electric current passing through an achromatic mirror magnet does not need to be altered. Accordingly, in the course of the operation of a synchrotron radiation source according to the invention, it is possible to avoid substantially all problems which are associated with the alteration of the magnetic excitation of a superconducting magnet. The large angle of deflection of 270° of the mirror magnet gives a large angular range into which the synchrotron radiation being generated is radiated. Consequently, a synchrotron radiation source according to the invention can be utilized simultaneously by many users.

The remainder of the beam guidance system of a synchrotron radiation source according to the invention can be constructed by using conventional technology.

In accordance with another feature of the invention, the beam guidance system has deflecting magnets (dipoles) and/or focusing magnets (quadrupoles) combined with one another in any desired manner in accordance with pertinent knowledge.

In accordance with a further feature of the invention, in certain circumstances it is advantageous to select the minimum radius of curvature of each deflecting magnet to be greater than the minimum radius of curvature of the mirror magnet. In this way, the generation of synchrotron radiation in the deflecting magnets is reduced. This gives rise to a reduction in the requirements imposed on the capacity of the accelerating devices which are to be provided in the beam guidance system and which must compensate for the energy loss in the circulating beams that is caused by the generation of the synchrotron radiation, as well as less stringent requirements on the shielding of the deflecting magnets, which shielding is required to provide protection from radiation.

In accordance with an added feature of the invention, the magnetic field which can be generated in the mirror magnet has a field index which is between approximately 0.8 and approximately 1.5; and the magnetic field in the mirror magnet is constant along a first direction and is variable in a second direction perpendicular to the first direction in such a way that it is proportional to a specified power of a depth of penetration being measured along the second direction from a point of entry. In this case, the field index is the exponent designating this power. Further information regarding this matter can be gathered from the aforementioned article by H. A. Enge. With a field index of the aforementioned magnitude, the properties of achromaticity can be achieved in the most advantageous manner. With such a field index, it is preferably possible to obtain an entirely afocal mirror magnet.

In accordance with an additional feature of the invention, the mirror magnet causes the trajectory in the mirror magnet to be bent through 270°.

In accordance with yet another feature of the invention, the mirror magnet has at least one beam tube for extracting the synchrotron radiation. Through the use of such a beam tube, it is possible to reliably guide the synchrotron radiation out of the synchrotron radiation source to its intended destination.

In accordance with yet a further feature of the invention, the synchrotron radiation for application in X-ray lithography and the like is generated by a particle beam being generated from electrons or positrons having a kinetic energy between approximately 400 MeV and approximately 2,000 MeV respectively.

In accordance with yet an added feature of the invention, the radius of curvature of a deflecting magnet that is not specifically constructed for the generation of synchrotron radiation, within the context of a synchrotron radiation source for the purposes of X-ray lithography or the like, has a value of approximately 1 m as a lower limit. Through the use of sufficiently large radii of curvature, it is possible to keep the synchrotron radiation generated in the deflecting magnets at an intensity which is preferably harmless from the point of view of radiation protection, so that effective radiation protection can be achieved by simple shielding measures.

Naturally, deflecting magnets with large radii of curvature result in certain losses in terms of the compactness of the synchrotron radiation source. However, in order to match the beam guidance system to specific spatial conditions (in some cases, three dimensional beam guidance) it is possible to make use of a whole range of possible structural variants, which would be virtually incapable of implementation with such freedom within the context of entirely superconducting synchrotron radiation sources.

In accordance with yet an additional feature of the invention, ferromagnetic yokes in the region of the bent particle trajectory in the interior of the mirror magnet are not used in the mirror magnet, and ferromagnetic components are employed at most for shielding purposes. Even in magnetic fields of modest magnitude, ferromagnetic components show marked saturation phenomena, so that the magnetic field strength in configurations including such components must be restricted to values of at most approximately 2 Teslas. The construction of a mirror magnet without ferromagnetic components has the effect of permitting particularly high fields, and thus particularly small radii of curvature and a particularly high output of synchrotron radiation.

In accordance with again another feature of the invention, there is provided a device, such as high-frequency resonator, for supplying energy into the particle beam and guiding the trajectory.

In accordance with again a further feature of the invention, the mirror magnet has two of the winding configurations being mutually congruent, being disposed opposite one another and substantially superimposed and being spaced from one another, between which the trajectory extends; each of the winding configurations has a multiplicity of windings, each of the windings has an approximately linear main portion; and all of the main portions of the winding configurations are disposed substantially parallel to one another and spaced from one another.

In accordance with again an added feature of the invention, each of the windings in each of the winding configurations has an approximately linear return portion; and all of the return portions of each of the winding configurations are combined into a return rod.

In accordance with again an additional feature of the invention, each of the winding configurations is approximately planar.

In accordance with a concomitant feature of the invention, the synchrotron radiation source is used for the generation of X-ray radiation for a process of X-ray lithography or X-ray microscopy.

Other features which are considered as characteristic for the invention are set forth in the appended claims.

Although the invention is illustrated and described herein as embodied in a synchrotron radiation source, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENT

Figure 1:
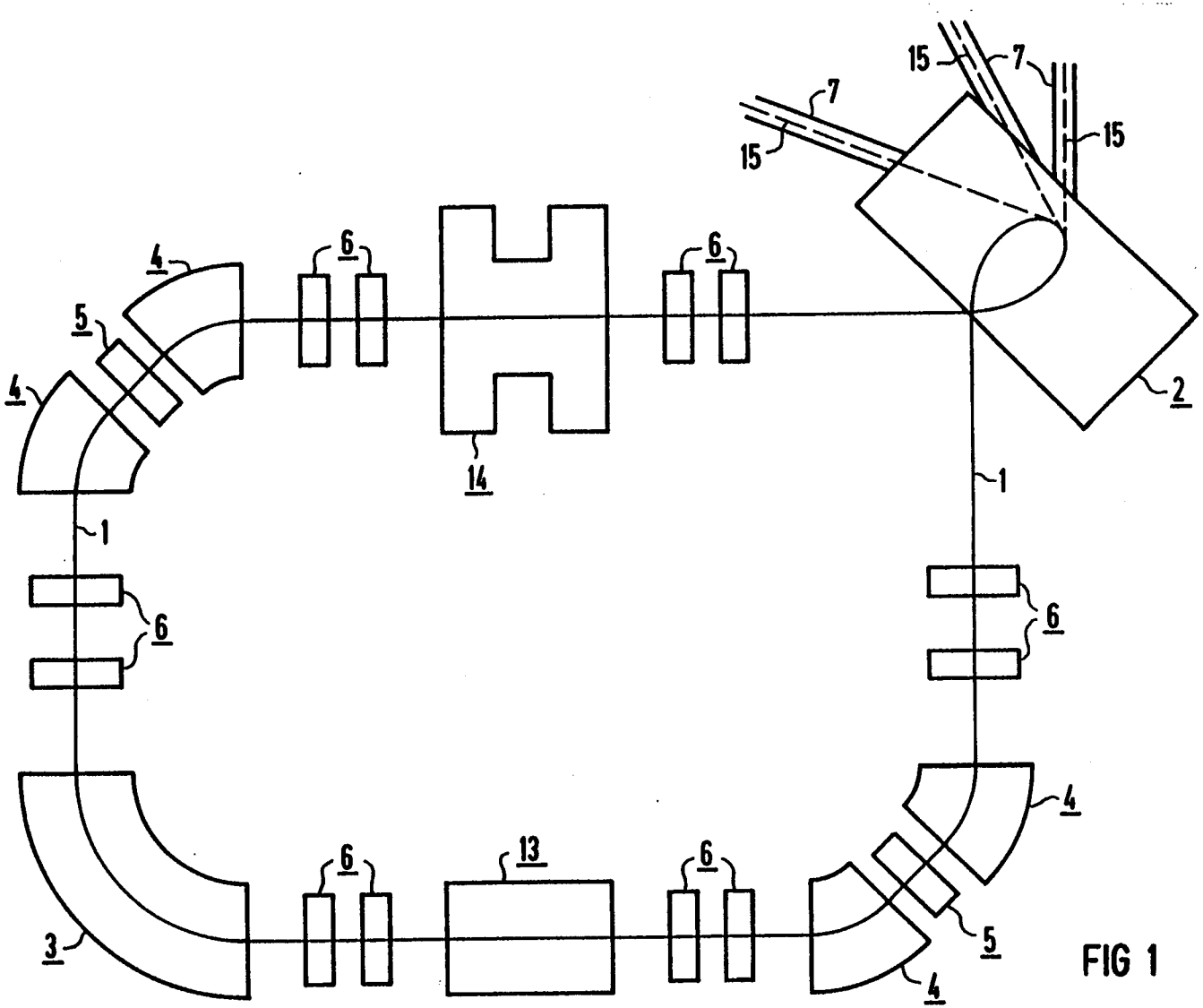
FIG. 1 is a diagrammatic view of a synchrotron radiation source according to the invention.

Referring now to the figures of the drawing in detail and first, particularly, to FIG. 1 thereof, there is seen an overall construction of a synchrotron radiation source according to the invention. Electrons or positrons which are to be accelerated and/or stored move along a trajectory 1 which is determined by various components of a beam guidance system. The beam guidance system preferably includes a mirror magnet 2, in which the particle trajectory 1 is deflected through 270° and is guided in a loop, as well as deflecting magnets 3, 4 and focusing magnets 5, 6. The deflecting magnets 3, 4 produce essentially magnetic dipole fields to bend the trajectory 1. The deflecting magnets 3, 4 may be constructed either as integral deflecting magnets 3 or as combinations of a plurality of deflecting magnets 4. If required, it is possible for special focusing magnets 5 to be included in the combination. The selection of the deflecting magnets 3, 4 has to be matched to the respective requirements of the individual case. It is possible to make a free choice with regard to the number of deflecting magnets 3, 4 to be provided, as well as with regard to the angle of deflection of each deflecting magnet. Furthermore, the focusing magnets 5, 6 of the beam guidance system are employed to shape the cross section of the particle beam and counteract intensity losses. This is all the more necessary since an industrial application of the synchrotron radiation source demands the availability of synchrotron radiation 15 of a type and strength which remain as uniform as possible on a long-term basis. Paired focusing magnets 6 and/or focusing magnets 5 connected with the deflecting magnets 4 are employed depending upon the particular requirement. Naturally, it is possible to include further components in the beam guidance system, for example devices for regulating the position of the particle beam in a plane perpendicular to the respective beam direction. It is usual to provide devices for building up the particle beam, for example a beam injector 13, as well as devices for accelerating the particles and for compensating for their energy loss occurring as a result of the generation of the synchrotron radiation 15, for example a high-frequency resonator 14. According to the invention, the synchrotron radiation 15 is extracted from the mirror magnet 2 and fed through beam tubes 7 to the respective application.

Figure 2:
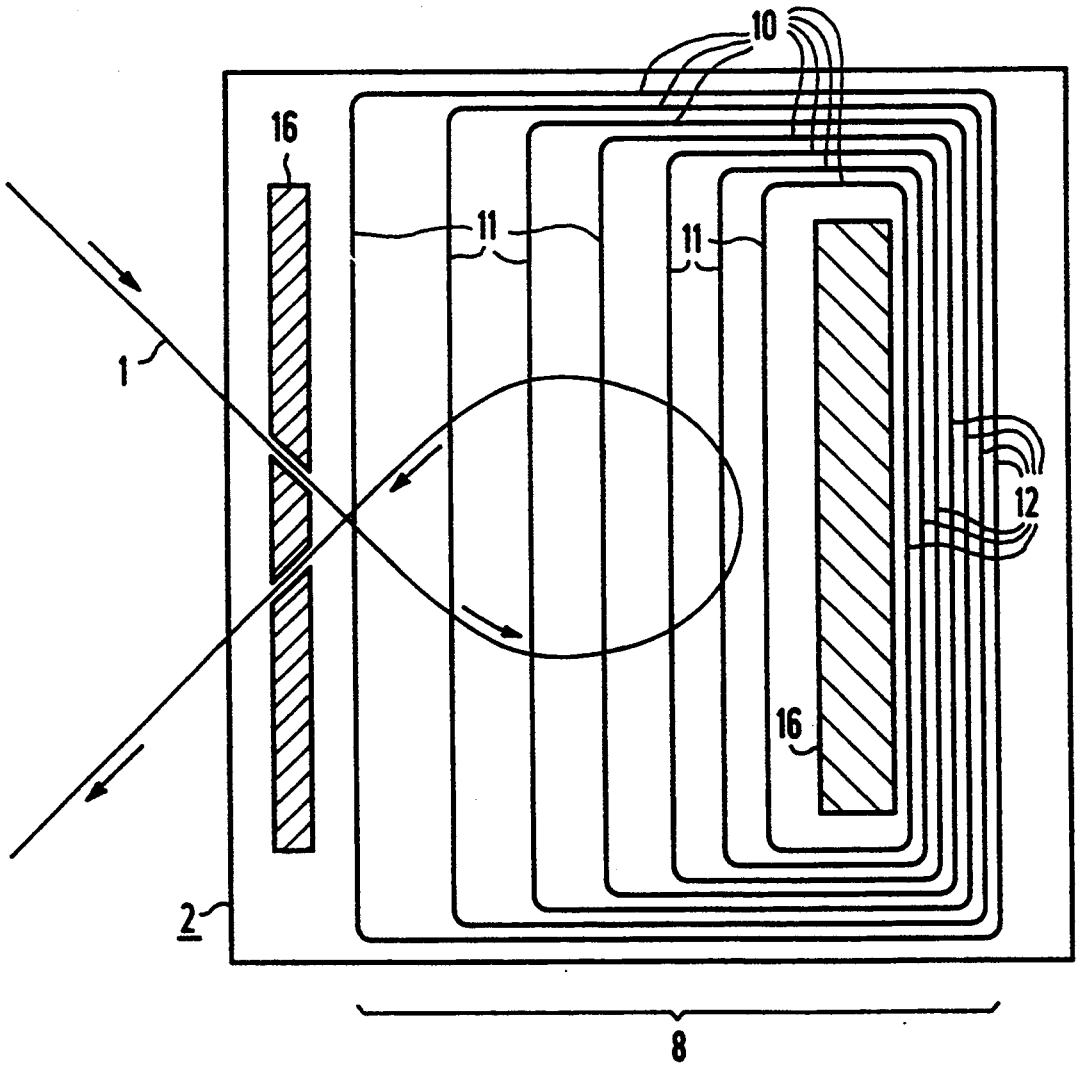
FIG. 2 is a sectional view and FIG. 3 is an exploded perspective view illustrating the construction of winding configurations in a mirror magnet for an application according to the invention.

FIG. 2 shows a winding configuration 8 of superconducting windings 10, which could be employed to form the mirror magnet 2. The representation should be regarded only as an outline and customary methods should be used to match the specific construction of the windings 10 to the requirements to be imposed on the mirror magnet 2. Each winding 10 has a main portion 11, which is disposed parallel to the plane containing the trajectory 1, above that region of the mirror magnet 2 which contains the trajectory 1. The main portions 11 are disposed at specific spacings from one another, so that the desired field is achieved in the plane of the trajectory 1. The windings 10 are closed by means of return portions 12, which are disposed in regions remote from the trajectory 1 in the mirror magnet. In addition to the winding configuration 8, shielding elements 16 are shown. On one hand, the shielding elements 16 shield the trajectory 1 outside the mirror magnet 2 from its magnetic field, and on the other hand, they keep the field generated by the return portions 12 remote from the trajectory 1.

Figure 3:
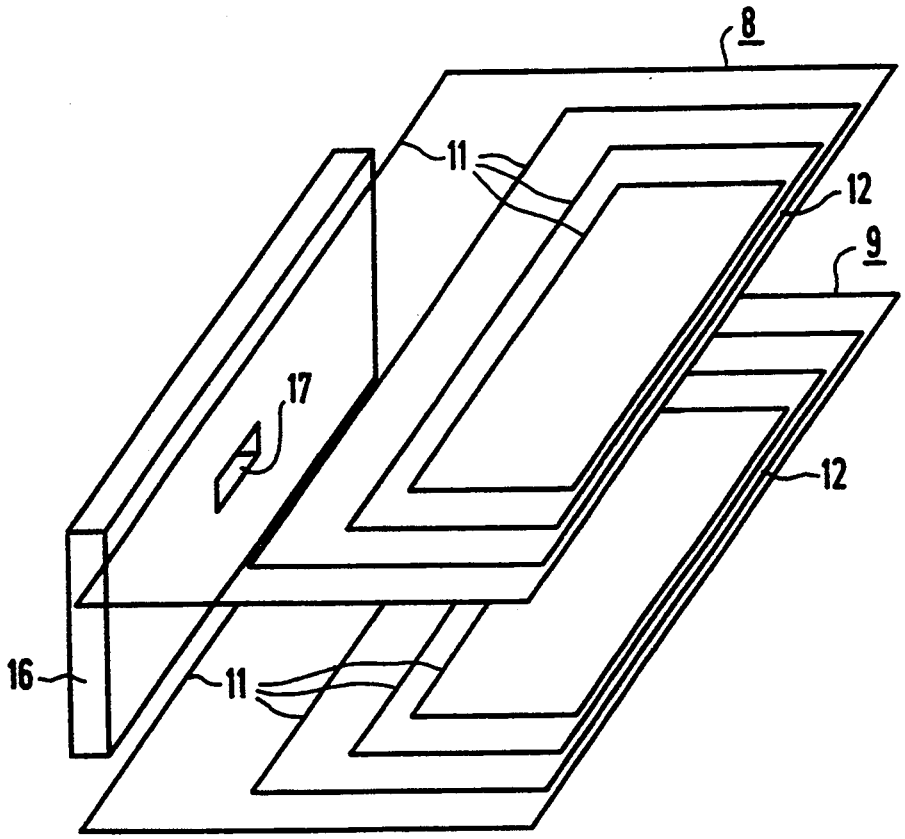

FIG. 3 shows the spatial relationship of upper and lower winding configurations 8, 9 to form a mirror magnet. The construction of the winding configurations 8, 9 with main portions 11 and return portions 12 has already been explained above. The upper winding configuration 8 and the lower winding configuration 9 are substantially superimposed, at a specific spacing one above the other, and the particles move approximately in a plane situated centrally between the upper winding configuration 8 and the lower winding configuration 9. The shielding or screening element 16 has an opening 17, through which a particle enters the magnetic field generated by the winding configurations 8, 9. In each case, the return portions 12 of the winding configurations 8, 9 are combined into compact return rods. In this way, it is possible to optimally take account of the mechanical requirements imposed on superconducting magnet configurations.

The invention provides a synchrotron radiation source which utilizes all of the advantages of superconductors and to a very great extent avoids their disadvantages. The synchrotron radiation source can be easily handled and permits the generation of synchrotron radiation with parameters which remain constant on a long-term basis and which are especially advantageous.

We claim:

1. A synchrotron radiation source, comprising a beam guidance system for storing an electron or positron particle beam on a closed trajectory, said beam guidance system having at least one approximately achromatic mirror magnet being formed of superconducting winding configurations for bending the trajectory through approximately 270°.

2. The synchrotron radiation source according to claim 1, wherein said beam guidance system has at least one of deflecting and focusing magnets formed of non-superconducting winding configurations.

3. The synchrotron radiation source according to claim 1, wherein:

a) said beam guidance system has deflecting magnets; and b) the trajectory has a minimum radius of curvature in each of said deflecting magnets and in said mirror magnet, and the minimum radius of curvature of the trajectory in said mirror magnet is smaller than the minimum radius of curvature of the trajectory in each of said deflecting magnets.

4. The synchrotron radiation source according to claim 1, wherein:

a) said mirror magnet has means for generating a magnetic field being constant along a first direction, being variable along a second direction perpendicular to the first direction and being proportional to a specified power of a depth of penetration to be measured along the second direction from a point of entry; and b) the magnetic field has a field index being an exponent designating said power and being between approximately 0.8 and approximately 1.5.

5. The synchrotron radiation source according to claim 1, wherein the trajectory is bent through 270° in said mirror magnet.

6. The synchrotron radiation source according to claim 1, wherein said mirror magnet has at least one beam tube for coupling out synchrotron radiation.

7. The synchrotron radiation source according to claim 1, including a device for supplying energy into the particle beam and guiding the trajectory.

8. The synchrotron radiation source according to claim 7, wherein said device is a high-frequency resonator.

9. The synchrotron radiation source according to claim 1, wherein said beam guidance system has means for storing electrons or positrons having kinetic energy between approximately 400 MeV and approximately 2,000 MeV.

10. The synchrotron radiation source according to claim 9, wherein said beam guidance system has deflecting magnets each having a radius of curvature being greater than approximately 1 m.

11. The synchrotron radiation source according to claim 1, wherein said mirror magnet has no ferromagnetic components in the vicinity of the trajectory within said mirror magnet.

12. The synchrotron radiation source according to claim 11, wherein:

a) said mirror magnet has two of said winding configurations being mutually congruent, being disposed opposite one another and substantially superimposed and being spaced from one another, between which the trajectory extends;

b) each of said winding configurations has a multiplicity of windings, each of said windings has an approximately linear main portion; and c) all of said main portions of said winding configurations are disposed substantially parallel to one another and spaced from one another.

13. The synchrotron radiation source according to claim 12, wherein:

a) each of said windings in each of said winding configurations has an approximately linear return portion; and b) all of said return portions of each of said winding configurations are combined into a return rod.

14. The synchrotron radiation source according to claim 12, wherein each of said winding configurations is approximately planar.

15. The synchrotron radiation source according to claim 13, wherein each of said winding configurations is approximately planar.

16. A synchrotron radiation source for the generation of X-ray radiation for a process of X-ray lithography or X-ray microscopy, comprising a beam guidance system for storing an electron or positron particle beam on a closed trajectory, said beam guidance system having at least one approximately achromatic mirror magnet being formed of superconducting winding configurations for bending the trajectory through approximately 270°.

* * * * *